US005852996A

United States Patent [19]

Nakamura et al.

[11] Patent Number: 5,852,996

[45] Date of Patent: Dec. 29, 1998

[54] THROTTLE VALVE POSITIONING CONTROL APPARATUS

[75] Inventors: Hideo Nakamura, Machida; Masashi Matsuyama, Kunitachi, both of Japan

[73] Assignee: Nissan Motor Co., Ltd., Kanagawa, Japan

[21] Appl. No.: 761,260

[22] Filed: Dec. 6, 1996

[30] Foreign Application Priority Data

Dec. 8, 1995 [JP] Japan ..... 7-320476

[51] Int. Cl.[6] ..... F02D 41/24

[52] U.S. Cl. ..... 123/399; 318/601; 318/632

[58] Field of Search ..... 123/350, 361, 123/396, 399; 318/601, 632

[56] References Cited

U.S. PATENT DOCUMENTS 5,389,867 2/1995 Adachi et al. ..... 318/601

5,406,920 4/1995 Murata et al. ..... 123/399

*Primary Examiner*—Andrew M. Dolinar

*Attorney, Agent, or Firm*—McDermott, Will & Emery

[57] ABSTRACT

An apparatus for controlling the positioning of a throttle valve situated to control the amount of air permitted to enter an internal combustion engine operable in a plurality of control modes. The apparatus includes a driver responsive to a drive signal indicating a target throttle valve position for moving the throttle valve to the target throttle valve position, a sensor sensitive to the movement of the throttle valve for producing a digital sensor signal indicative of a sensed throttle valve position, and a control unit for producing the drive signal to bring the sensed throttle valve position into coincidence with the target throttle valve position. The disturbances introduced onto the driver and the sensor are estimated based on the target and sensed throttle valve positions. The target throttle valve position is corrected based on the estimated disturbances.

31 Claims, 8 Drawing Sheets

THROTTLE VALVE POSITIONING CONTROL APPARATUS

BACKGROUND OF THE INVENTION

This invention relates to an apparatus for controlling the positioning of a throttle valve situated to control the amount of air permitted to enter an internal combustion engine.

Throttle valve positioning control apparatus have been utilized in various applications including driving force control made to realize an optimum acceleration feeling in response to an operator's accelerator operation, traction control made to suppress slip on the driven wheels, cruising control to realize automatic vehicle driving at a constant speed set by the operator, and engine idle speed control. If such a throttle valve positioning control apparatus is used with a throttle valve actuator, it is required to have good throttle control characteristics such as response characteristic, stability, disturbance suppressing ability and resolution according to its application. A great throttle control resolution is required, for example, when the throttle valve control is used to adjust a small-diameter auxiliary valve situated in an air passage bypassing the throttle valve for engine idling control. Alternatively, a first throttle control response characteristic is required when the throttle valve is moved with the use of a throttle valve actuator rather than a mechanical linkage connected between the accelerator pedal and the throttle valve. With the use of an actuator, such as an electric motor, to drive a butterfly type throttle valve, however, the throttle valve control is influenced considerably by various disturbances and nonlinear factors (static friction, motor torque ripples, temperature variations, intake manifold negative pressure variations, throttle valve position measurement noises, throttle valve position measurement resolution, and the like). This is true particularly for engine idling control.

SUMMARY OF THE INVENTION

It is a main object of the invention to provide an improved throttle valve positioning apparatus which can eliminate the influence of disturbances and nonlinear factors to provide excellent control resolution and control response characteristics.

There is provided, in accordance with the invention, an apparatus for controlling the positioning of a throttle valve situated to control the amount of air permitted to enter an internal combustion engine operable in a plurality of control modes. The apparatus comprises drive means responsive to a drive signal indicating a target throttle valve position for moving the throttle valve to the target throttle valve position, sensor means sensitive to the movement of the throttle valve for producing a digital sensor signal indicative of a sensed throttle valve position, and control means connected between the sensor means and the drive means for producing the drive signal to bring the sensed throttle valve position into coincidence with the target throttle valve position. The control means includes disturbance estimating means for estimating disturbances introduced onto the drive means and the sensor means based on the target and sensed throttle valve positions, and means for correcting the target throttle valve position based on the estimated disturbances.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
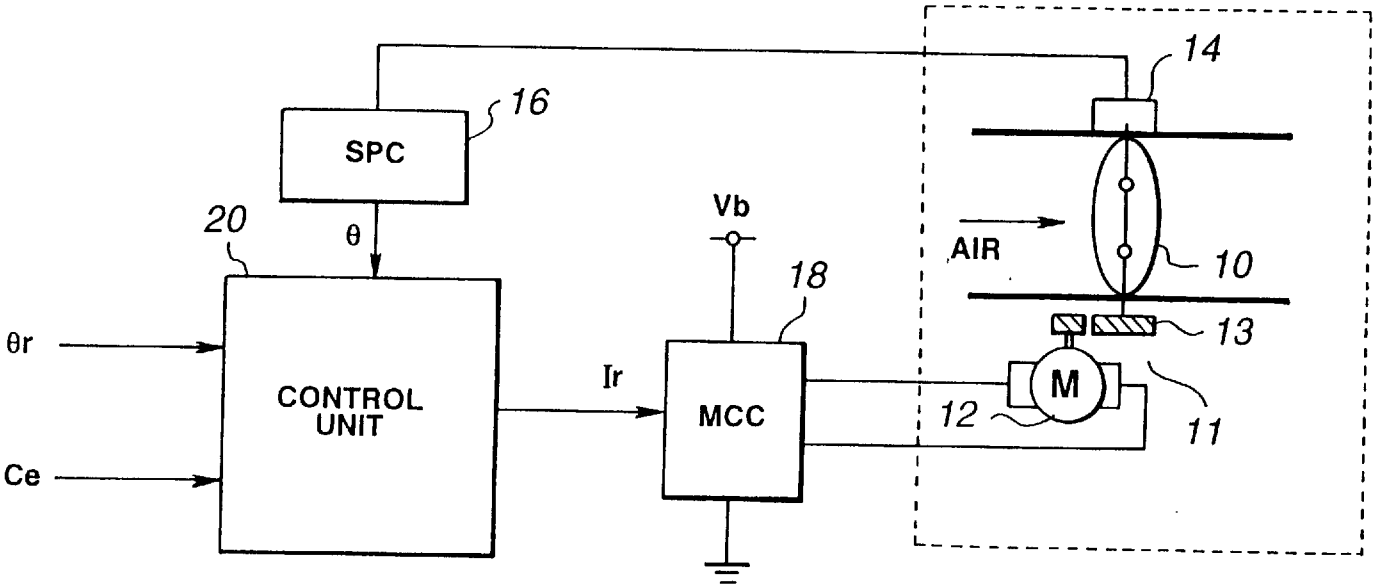
FIG. 1 is a schematic diagram showing one embodiment of a throttle valve positioning control apparatus made in accordance with the invention.

With reference to the drawings and in particular to FIG. 1, there is sown a schematic block diagram of a throttle valve positioning control apparatus embodying the present invention. A butterfly type throttle valve 10 is situated for rotation within the induction passage of the engine to control the amount of air permitted to enter the engine. The throttle valve is rotated by a throttle valve actuator 11 which is shown as including a DC motor 12 from which a drive is transmitted through a reduction gear unit 13 to rotate the throttle valve in an opening direction against the resilient force of a return spring (not shown). A throttle valve position sensor 14 is associated with the throttle valve 10 for producing an output in the form of an analog sensor signal indicative of the existing throttle valve position, that is, the degree to which the throttle valve 10 opens. Preferably, the throttle valve position sensor 14 is of the type including an inexpensive potentiometer connected in a voltage divider circuit for producing a voltage proportional to the throttle valve position. It is to be understood, of course, that the throttle valve position sensor 14 may be of the type including an optical encoder. The sensor signal produced from the throttle valve position sensor 14 is fed to a signal processor circuit (SPC) 16 which amplifies the received sensor signal and converts the amplified sensor signal into a corresponding digital signal indicative of the sensed throttle valve position θ.

A control unit, generally designated by the numeral 20, receives various data related to the sensed throttle valve position θ, a target throttle valve position θ r and existing engine control conditions Ce. The control unit 20 performs various calculations based on the received data and produces a control signal indicative of a desired or target motor current Ir. The target motor current Ir is transferred to a motor current control circuit (MCC) 18 which thereby controls the time intervals at which a power transistor included therein is switched to supply an electric current to drive the DC motor 12 in such a manner as to bring the sensed throttle valve position θ into coincidence with the target throttle valve position θr. In the illustrated case, the control unit 20 is arranged to correct the control signal (target motor current Ir, based on the sensed throttle valve position θ, for the disturbances introduced onto the control line including the motor current control circuit 18, the throttle valve actuator 11, the throttle valve position sensor 14 and the signal processor circuit 16.

Figure 2:
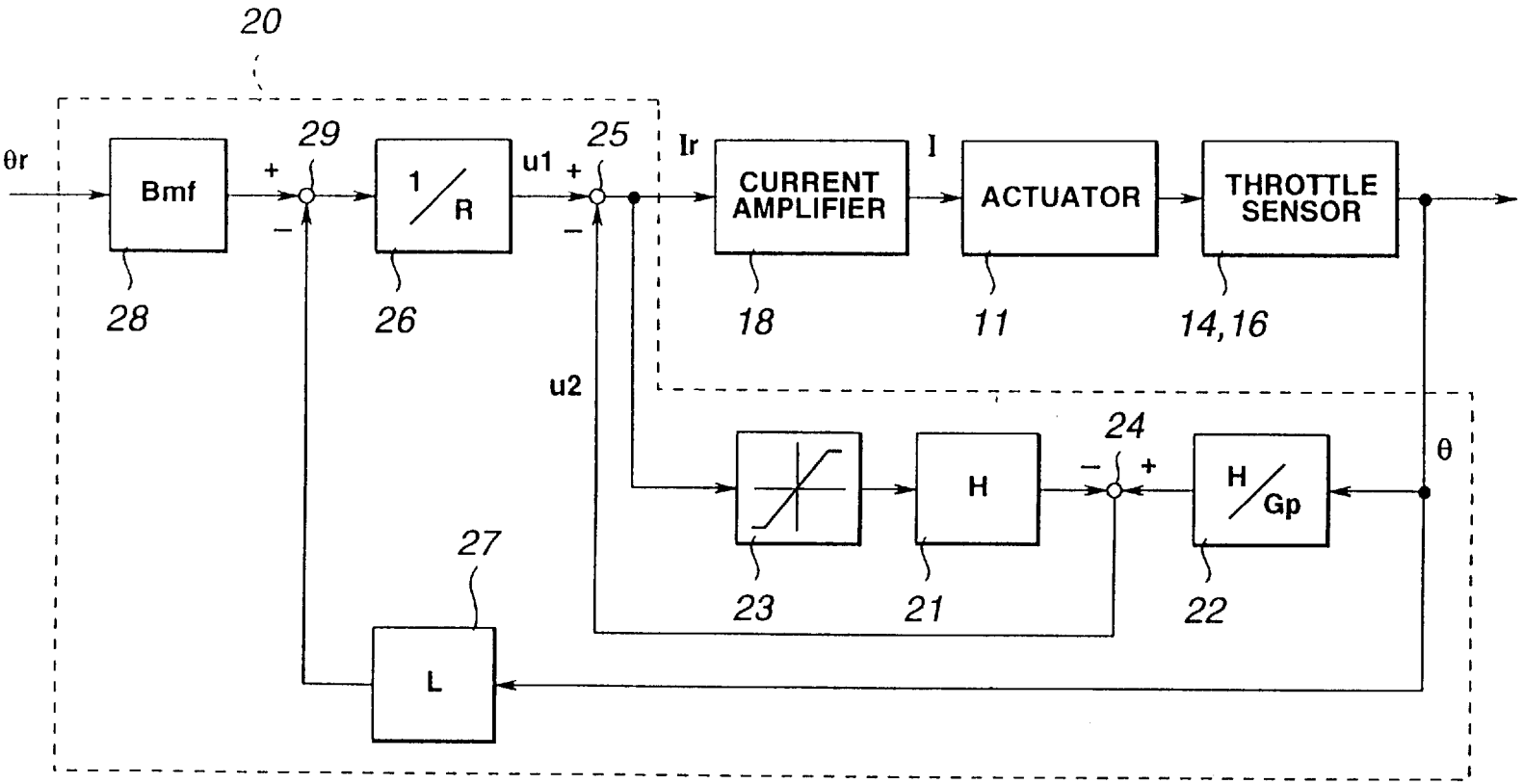
FIG. 2 is a block diagram showing the detailed arrangement of the control unit used in the throttle valve positioning control apparatus of FIG. 1.

Referring to FIG. 2, the control unit 20 includes a disturbance compensator comprised of various control blocks 21 to 25 for decreasing the sensitivity with respect to disturbances and parameter errors and also a model matching compensator comprised of various control blocks 26 to 29 for providing an optimized response characteristic of the sensed throttle valve position θ with respect to the target throttle valve position θr. Assuming now that the transfer characteristic Gp(s) of the control line including the motor current control circuit 18, the throttle valve actuator 11, the throttle valve position sensor 14 and the signal processor circuit 16 is given as $Gp(s)=K/(as^2+bs+c)$, the discrete transfer characteristic $Gp(z^{-1})$ is given as $$Gp(z^{-1}) = \frac{z^{-1}\cdot(bp0+bp1\cdot z^{-1})}{1+ap1\cdot z^{-1}+ap2\cdot z^{-2}} = \frac{z^{-1}\cdot(bp0+bp1)}{1+ap1\cdot z^{-1}+ap2\cdot z^{-2}}\cdot\frac{bp0+bp1\cdot z^{-1}}{bp0+bp1} \quad (1)$$

$$Q(z^{-1}) = \frac{bp0+bp1\cdot z^{-1}}{bp0+bp1} \quad (2)$$

Using this equation, the discrete transfer characteristic $Gp(z^{-1})$ may be rearranged to give $$Gp(z^{-1})) = \frac{z^{-1}\cdot(bp0+bp1)}{1+ap1\cdot z^{-1}+ap2\cdot z^{-2}}\cdot Q(z^{-1}) \quad (3)$$

The tendency of the zero point (−bp1/bp0) of the discrete transfer characteristic $Gp(z^{-1})$ to converge to −1 increases as the sampling frequency increases. Thus, the disturbance compensator will operate in an unstable manner if the reciprocal of the discrete transfer characteristic $Gp(z^{-1})$ is used for the disturbance compensator. In order to avoid such unstable operation, the disturbance compensator is designed to include control blocks 21 to 25. The control block 21 includes a filter $H(z^{-1})$ which is a low pass filter $H0(z^{-1})$ having a stationary gain of 1 with the function $Q(z^{-1})$ having the zero point of the discrete transfer characteristic $Gp(z^{-1})$. The control block 21 converts the target motor current Ir into a target motor current value Ir' through low pass filter process. The low pass filter $H(z^{-1})$ is represented as $$H(z^{-1})=H0(z^{-1})\cdot Q(z^{-1}) \quad (4)$$

The control block 22 includes a filter $H(z^{-1})/Gp(z^{-1})$ which cancels the tendency of the zero point to converge to −1. Thus, the control block 12 is stable digital filter. The control block 22 performs the reverse calculation of the target motor current, based on the discrete transfer characteristic $Gp(z^{-1})$ of the control line and the sensed throttle valve position θ and it outputs a target motor current value Ir" through low pass filter process. The control block 24 includes a subtractor which subtracts the target motor current value Ir' from the target motor current value Ir to estimate a disturbance value u2, that is, the deviation of the target motor current Ir caused by the disturbances and/or parameter errors introduced onto the control line. The control block 25 is a subtractor which subtracts the estimated disturbance value u2 from a target current value u1 to produce a corrected target motor current Ir free from the influence of the disturbances and/or parameter errors introduced onto the control line. This corrected target motor current Ir is fed to the motor current control circuit 18. The estimated disturbance value U2 is zero with no disturbances and parameter errors introduced onto the control line. In the presence of disturbances d and parameter errors Δ introduced onto the control line, the sensed throttle valve position θ is given as $$\theta = \frac{1+\Delta}{1+\Delta\cdot H(z^{-1})}\cdot Gp(z^{-1}(u1+(1-H(z^{-1}))\cdot d) \quad (5)$$

For the frequency band where the gain of the low pass filter $H(z^{-1})$ is 1, $$\theta=Gp(z^{-1})\cdot u1 \quad (6)$$

As can be seen from Equation (6) that the dynamic characteristic of the control line can be represented by the nominal model $Gp(z^{-1})$ since the influence of the disturbances and parameter errors is canceled completely. Although it is possible to expand the frequency range where a similar effect is achieved by increasing the cutoff frequency of the low pass filter $H(z^{-1})$, the margin for stable operation will decrease because of high-gain feedback. In this case, a tradeoff design will be required. The control block 23 includes a limiter witch sets upper and lower limits for the motor current to limit the input to the disturbance compensator when the motor current is saturated. This is effective to prevent accumulation of errors in the estimated disturbance value u2 which would degrade the response characteristic.

Description will be made to the model matching compensator. A desired response characteristic of the control line including the motor current control circuit 18, the throttle valve actuator 11, the throttle valve position sensor 14 and the signal processor circuit 16 is given as a reference model transfer characteristic $Gm0(s)=K/(as^2+bs+c)$. Like the transfer characteristic $Gp(z^{-1})$, the tendency of the zero point of the discrete reference model transfer characteristic $Gm0(z^{-1})$ to converge to −1 increases as the sampling frequency increases. In designing the model matching compensator to cancel the disturbances and parameter errors, therefor, the transfer characteristic $Gm(z^{-1})$ where the zero point of the reference model transfer characteristic $Gm0(z^{-1})$ is replaced with the zero point of the transfer characteristic $Gp(z^{-1})$ is used as the reference model transfer characteristic. The transfer characteristic $Gm(z^{-1})$ is given as $$Gm(z^{-1}) = \frac{z^{-1}\cdot(bm0+bm1)}{1+am1\cdot z^{-1}+am2\cdot z^{-2}}\cdot\frac{bp0+bp1\cdot z^{-1}}{bp0+bp1} \quad (7)$$

It is to be understood that there is substantially no difference between $Gm(z^{-1})$ and $Gm0(z^{-1})$ at low sampling frequencies. In this case, the discrete reference model transfer characteristic $Gm0(z^{-1})$ can be used with no trouble in practice.

Using the coefficients in Equations (1) and (7), the control blocks 26, 27 and 28 of the model matching compensator are represented respectively by $1/R(z^{-1})$, $L(z^{-1})$ and Bmf given as $$R(z^{-1})=1+r\cdot z^{-1}$$

$$L(z^{-1})=g0+g1\cdot(z^{-1})$$

$$Bmf=(bm0+bm1)/(bp0+bp1)$$

$$g1 = \frac{(am2-ap2)\cdot bp0-(am1-ap1)\cdot bp1}{bp0\left(-\frac{ap1}{ap2}\cdot bp1+bp0\right)+\frac{bp1^2}{ap2}}$$

-continued $$g0 = \left( am1 - ap1 + \frac{bp1}{ap2} \cdot g1 \right) \cdot \frac{1}{bp0}$$

$$r = -\frac{bp1}{ap2} \cdot g1$$

where

Figure 3:
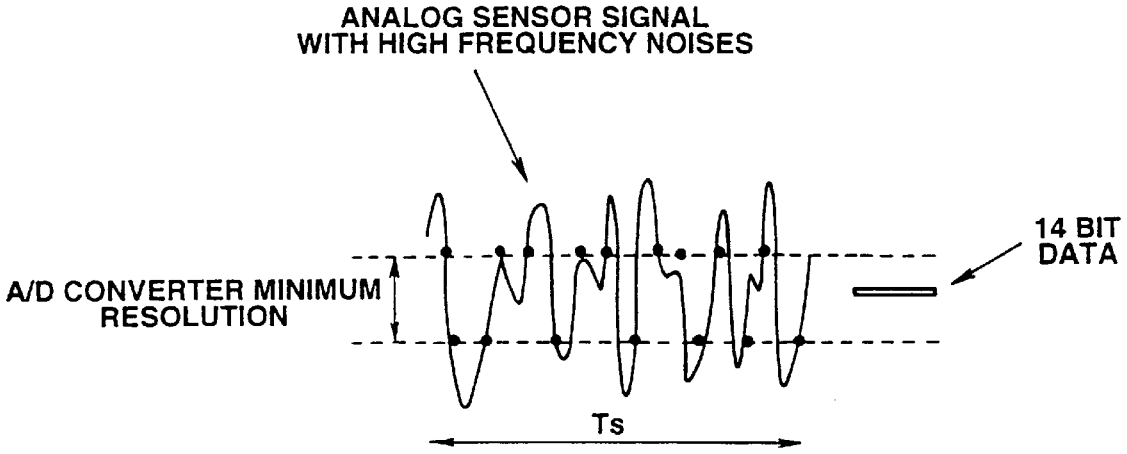
FIG. 3 is a graph used in explaining a modified form of the analog-to-digital conversion made in the throttle valve positioning control apparatus.

In the above embodiment, the analog sensor signal produced from the throttle valve position sensor 14 is converted into digital form at sampling intervals of time for calculations performed in the disturbance and model-matching compensators of FIG. 2. If the A/D conversion has an insufficient resolution, however, the disturbance compensator (control blocks 26 to 29) cannot function in such an effective manner as to provide a desired throttle valve control resolution. It is, therefore, preferable to increase the resolution of the A/D conversion in a pseudo manner by averaging the digital values obtained through the continuous A/D conversions of the analog sensor signal produced from the throttle valve position sensor 14. FIG. 3 illustrates such an over sampling process. Assuming now that calculations are made in the disturbance and model-matching compensators at sampling time intervals of 2 ms, the A/D conversion is continuously repeated a predetermined number of (in the illustrated case 16) times for the time interval of 2 ms. The 16 A/D converted values are averaged to provide 14 bit data which are used, as the sensed throttle valve position θ, for calculations performed in the disturbance and model-matching compensators. In this case, the A/D conversion time interval should be sufficiently shorter than the sampling time interval Ts (in the illustrated case 2 ms). This modification is effective to eliminate the influence of the noises introduced onto the analog sensor signal produced from the throttle valve position sensor 14 for high-frequency noises having a frequency higher than the repetitive rage of the A/D conversions and close to normal distribution. It is preferable to decrease the work of the digital computer by increasing the number of times the A/D conversions is repeated only during an engine idling control mode. The engine idling control mode may be detected based on the engine speed and the throttle valve position.

Figure 4:
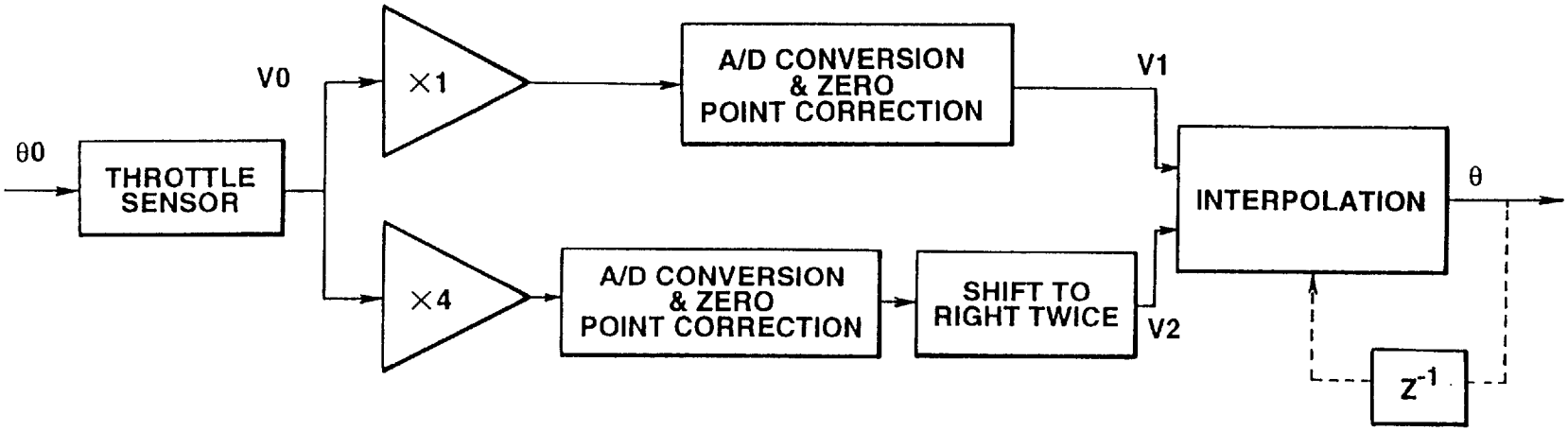
FIG. 4 is a block diagram used in explaining a modified form of production of the sensed throttle valve position.
Figure 5A:
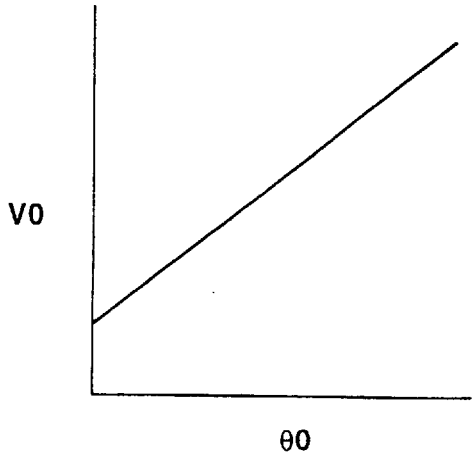
FIG. 5A is a graph of throttle position versus sensor output.
Figure 5B:
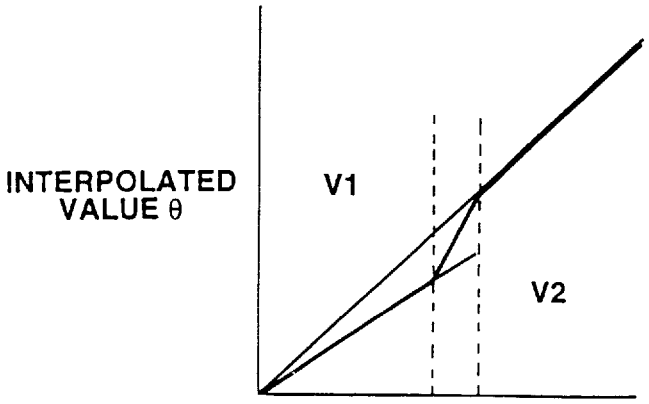
FIG. 5B is a graph used in explaining the interpolated value in connected with the converted values.

In the above embodiment, the analog sensor signal produced from the throttle valve position sensor 14 is amplified and converted into digital form. Because of the noises introduced onto the analog sensor signal, however, the disturbance compensator (control blocks 21 to 25) cannot function in such an effective manner as to provide a desired throttle valve control resolution. It is, therefore, preferable to reduce the high-frequency noises exceeding the effective frequency band of the amplifier of the signal processor circuit 16 by amplifying the analog sensor signal produced from the throttle valve position sensor 14 to a great extent. Since an upper limit exists for the voltage to be inputted to the A/D converter of the signal processor circuit 16, it is preferable to amplify the analog sensor signal only for an engine idling control mode requiring a very high throttle control resolution. This modification will be described in connection with the schematic block diagram of FIG. 4. The analog sensor signal VO produced from the throttle valve position sensor 14 is amplified by an amplifier having a predetermined amplification factor (in the illustrated case 4) for an engine idling control mode. The amplified analog sensor signal is converted into digital form. After the zero point correction, it is shifted twice to the right for unit regulation to provide an A/D converted value V2. For other control modes, the analog sensor signal V0 is fed, without any modification, to the A/D converter. After the zero point correction, the A/D converted value V1 is transferred for interpolation. The A/D converted values V1 and V2 are selectively interpolated for smooth connection of the A/D converted values V1 and V2, as shown in FIG. 5B. the interpolated value θ is used, as the sensed throttle value position θ, in the disturbance and model-matching compensators. The interpolation is made as $$\theta = k \cdot V2 + (1-k) \cdot V1$$

where k=1 when V1≦θ1, 0<k<0 when θ2<V1<θ1 and k=0 when θ2≦V1.

The disturbance compensator includes a low pass filter $H(z^{-2})$ for suppressing the disturbances and adjusting the tradeoff point. In the above embodiment, the low pass filter has a fixed frequency characteristic. However, it is preferable to attach a greater importance to the disturbance suppressing performance by changing the cutoff frequency of the low pass filter $H(z^{-1})$ to a greater value during the engine idling control mode.

Figure 6:
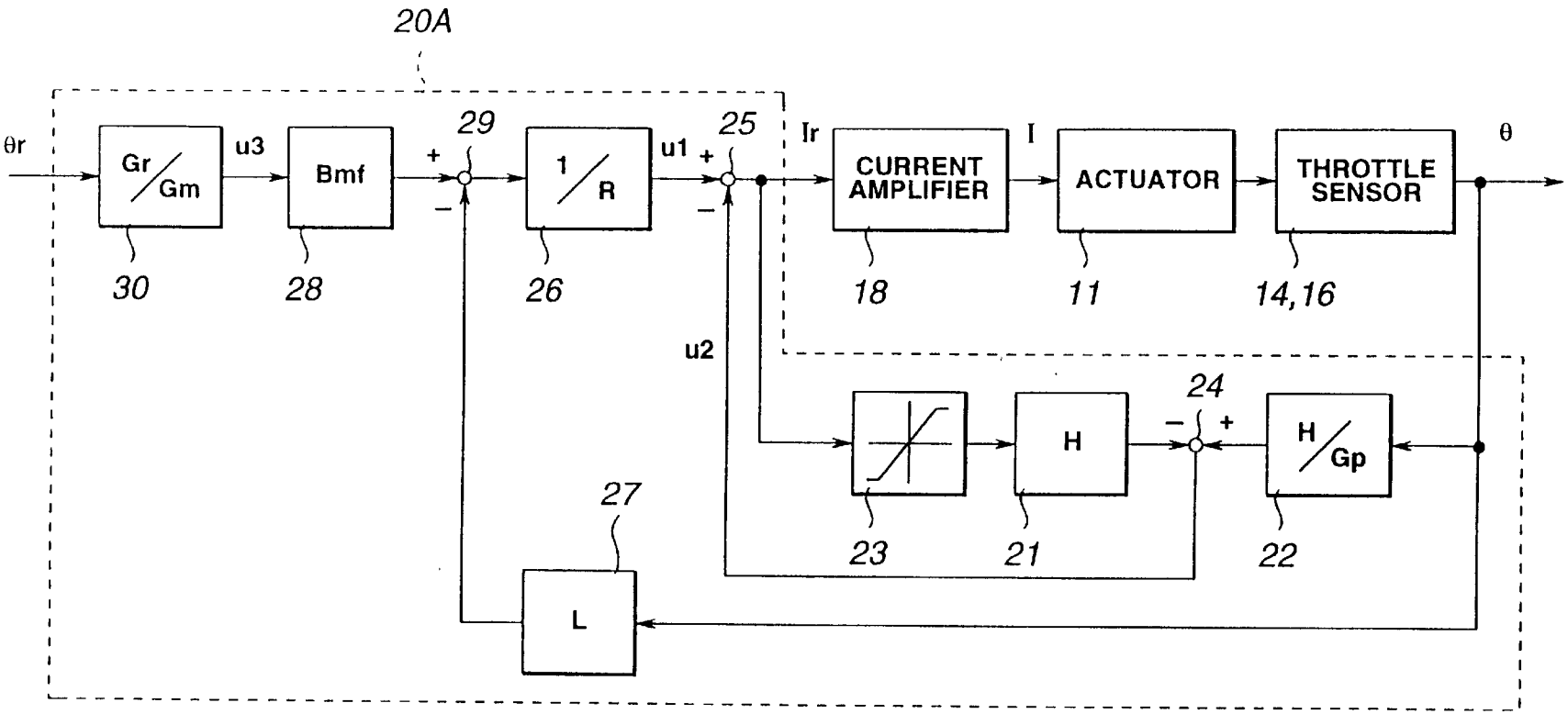
FIG. 6 is a block diagram showing a modified form of the control unit used in the throttle valve positioning control apparatus.

In the above embodiment, the feedback type model matching compensator is used to coincide the response characteristic of the actual throttle valve position with respect to the target throttle valve position with the transfer characteristic of the reference model $Gm(z^{-1})$. Thus, it is impossible to set a reference model having a sharp transfer characteristic to provide a high-gain feedback without any margin sufficient for stable closed loop operation. For this reason, a feed forward type phase advance compensator (control block 30) $Gr(z^{-1})/Gm(z^{-1})$ is provided prior to the control block 28, as shown in FIG. 6. The feedback type model matching compensator (control blocks 26 to 29) coincides the response characteristic with a dull temporary transfer characteristic $Gm(z^{-1})$ and the feed forward type phase compensator 30 coincides the response characteristic with a desired sharp transfer characteristic $Gr(z^{-1})$. When the throttle valve positioning control apparatus operates under a condition where the motor current reaches its upper limit frequently, however, the feedback type model matching compensator (control blocks 26 to 29) coincides the response characteristic with a sharp temporary transfer characteristic $Gm(z^{-1})$ and the feed forward type phase compensator (control block 30) coincides the response characteristic with a desired transfer characteristic $Gr(z^{-1})$ so as to keep the response characteristic from deterioration. The reason for this is that the dynamic characteristic of the throttle valve actuator cannot be fixed with the use of the compensator as long as the motor current reaches the upper limit. It is, therefore, preferable to suppress the deviation from the reference model produced while the motor current remains at its upper limit after the motor current decreases from the upper limit by setting the feedback type model matching compensator (control blocks 26 to 29) to have a high feedback gain. Since the reciprocal of the temporary reference model transfer characteristic $Gm(z^{-1})$ is used in designing the phase compensator (control block 30) like the model matching compensator (control blocks 26 to 29), the transfer characteristic $Gr(z^{-1})$ where the zero point of a desired reference model transfer characteristic $Gr0(z^{-1})$ is replaced with the zero point of the transfer characteristic $Gm(z^{-1})$. The transfer characteristic $Gr(z^{-1})$ is given as $$Gr(z^{-1}) = \frac{z^{-1} \cdot (br0 + br1)}{1 + ar1 \cdot z^{-1} + ar2 \cdot z^{-2}} \cdot \frac{bp0 + bp1 \cdot z^{-1}}{bp0 + bp1}$$

It is to be understood that there is substantially no difference between $Gr(z^{-1})$ and $Gr0(z^{-1})$ at low sampling frequencies. In this case, the discrete reference model transfer characteristic $Gm0(z^{-1})$ can be used with no trouble in practice.

Figure 7:
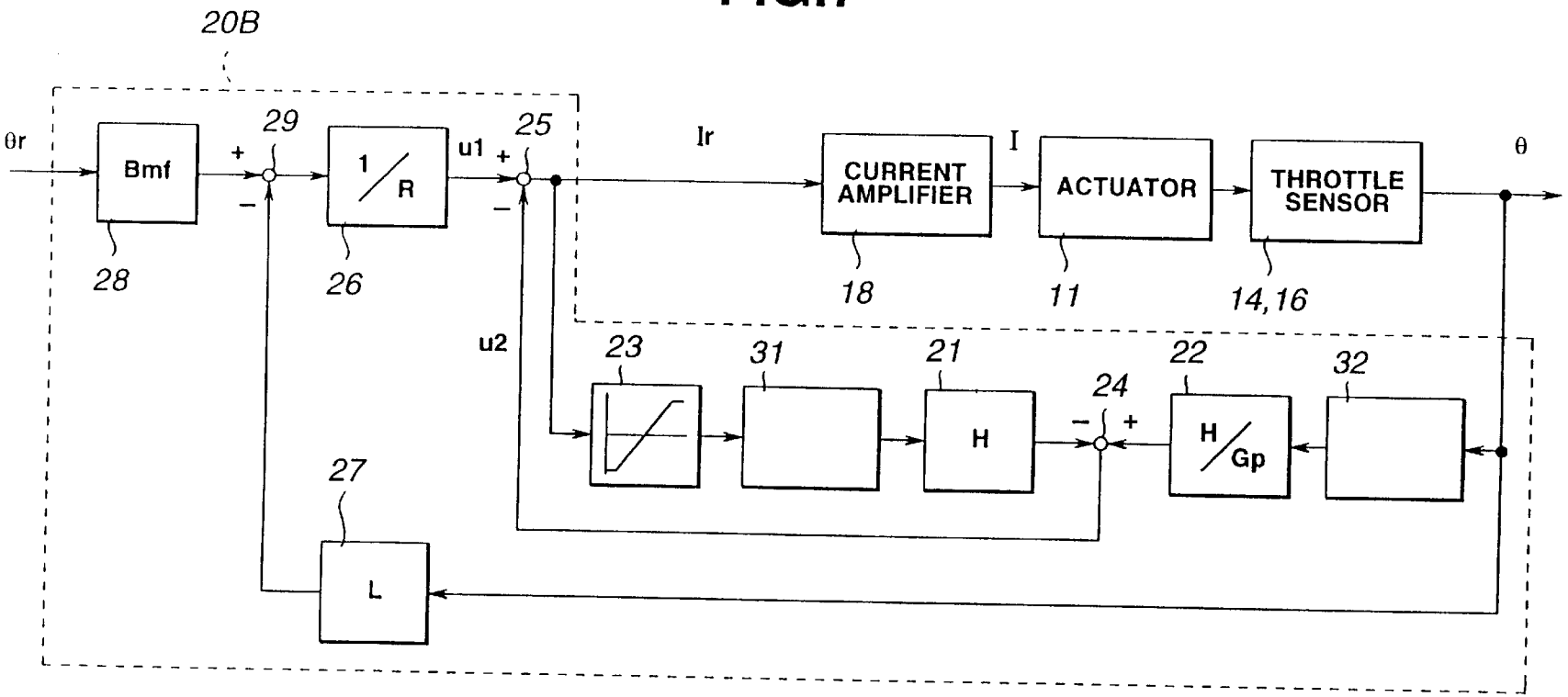
FIG. 7 is a block diagram showing another modified form of the control unit used in the throttle valve positioning control apparatus.
Figure 8:
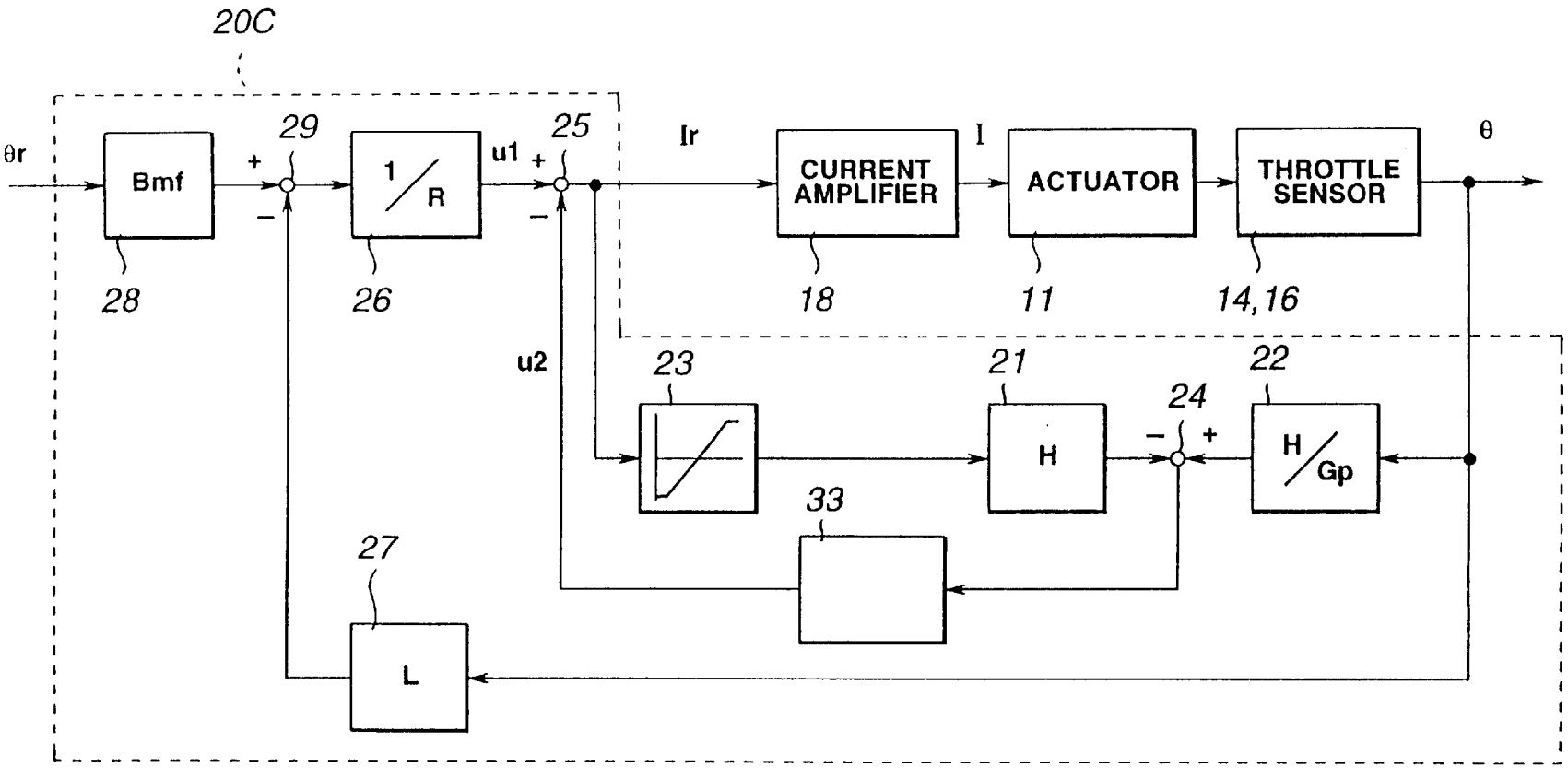
FIG. 8 is a block diagram showing a still another modified form of the control unit used in the throttle valve positioning control apparatus.

In order to realize a very great throttle control resolution with the use of a throttle valve actuator affected greatly by its static friction, it is required to increase the cutoff frequency of the low pass filter of the disturbance compensator (control blocks 21 to 25) to such a great degree that the disturbance compensator (control blocks 21 to 25) has a high gain characteristic over a wide frequency range including the high frequency band. In this case, the influence of the instrumental noises increases. In order to eliminate the increased influence of the instrumental noises, low pass filters 31 and 32 are provided at the respective inputs of the disturbance compensator (control blocks 21 to 25), as shown in FIG. 7. Alternatively, a low pass filter 33 may be provided at the output of the disturbance compensator (control blocks 21 to 25) to eliminate the increased influence of the instrumentation noises, as shown in FIG. 8. These modifications as shown in FIGS. 7 and 8 can operate without any delay which may be produced with the use of a low pass filter at the output of the throttle valve position sensor 14 and realize superior disturbance suppressing performance and operation stability.

According to the invention, the disturbances introduced onto the motor control circuit (current amplifier) 18, the throttle valve actuator 11, the throttle valve position sensor 14 and the signal processor circuit 16 are estimated based on the target and sensed throttle valve positions. The target throttle valve position is then corrected based on the estimated disturbances. The disturbances introduced onto the components 11, 14, 16 and 18 are estimated as an error between the target throttle valve position and the throttle valve position obtained by the reverse calculation based on the dynamic characteristic of the components derived from the sensed throttle valve position. The estimated disturbances are used to correct the target throttle valve position to eliminate the influence of the disturbances so as to improve the throttle valve positioning control resolution and response characteristic. This is effective to hold the dynamic characteristic of the components constant. The disturbances include temperature variations, intake manifold negative pressure variations, power source voltage variations, nonlinear factors (such as static friction and motor torque ripples), changes of the components with time, and the like.

An analog sensor signal is fed from a throttle valve position sensor associated with the throttle valve. Preferably, an analog-to-digital converter is provided for repetitively converting the analog sensor signal into a corresponding digital value at uniform intervals of time. The digital values converted in sequence for a predetermined period of time are summed and averaged to indicate the sensed throttle valve position in the form of a digital sensor signal produced to the control circuit 20. This is effective to increase the resolution of the analog-to-digital converter in a pseudo fashion so as to permit accurate disturbance estimation particularly in a specified (engine idling) control mode where the engine is operating. Preferably, the time interval is changed according to the control mode where the engine is operating. For example, the frequency at which the analog sensor signal is converted is increased only during engine idling control requiring a high throttle resolution. During other engine control modes, this frequency is decreased to reduce the work of the digital computer used for the throttle valve positioning control.

Preferably, a plurality of amplifiers are provided for amplifying the analog sensor signal at different amplification factors. The amplified analog sensor signals are converted into corresponding digital values. One of the digital value is selected according to the engine control mode to indicate the sensed throttle valve position in the form of a digital sensor signal produced to the control circuit 20. For example, the digital value into which the analog sensor signal amplified at a greater amplification factor is converted is selected at a narrower throttle valve position. This is effective to reduce the noises with respect to the signal component indicating the actual throttle valve movement. Furthermore, this permits effective and accurate disturbance estimation at very narrow throttle valve positions. It is also preferable to interpolate the digital values based on a selected one of the digital values to indicate the sensed throttle valve position in the form of a digital sensor signal produced to the control circuit 20. This is effective to permit smooth connection of the digital values so as to improve the throttle valve control stability.

Preferably, the digital values are interpolated based on one of the digital value selected according to the control mode where the engine is operating to indicate the sensed throttle valve position in the form of a digital sensor signal produced to the control circuit 20. Alternatively, the digital values are interpolated based on the interpolated value obtained in the last cycle of production of the digital sensor signal to indicate the sensed throttle valve position in the form of a digital sensor signal produced to the control circuit 20.

Preferably, the frequency characteristic of the disturbance estimation circuit is changed according to the control mode where the engine is operating. For example, the cutoff frequency is increased to increase the disturbance suppressing ability so as to realize high-resolution throttle control in an engine idling control mode.

What is claimed is:

1. The throttle valve positioning control apparatus, for controlling the positioning of a throttle valve situated to control the amount of air permitted to enter an internal combustion engine operable in a plurality of control modes, comprising:

drive means responsive to a drive signal indicating a target throttle valve position for moving the throttle valve to the target throttle valve position;

sensor means sensitive to the movement of the throttle valve for producing a sensor signal indicative of a sensed throttle valve position; and control means connected between the sensor means and the drive means for producing the drive signal to bring the sensed throttle valve position into coincidence with the target throttle valve position, the control means including disturbance estimating means for estimating disturbances introduced onto the drive means and the sensor means based on the target and sensed throttle valve positions, and means for correcting the target throttle valve position based on the estimated disturbances, further including a low pass filter provided at an output of the disturbance estimating means for eliminating noises introduced onto the output of the disturbance estimating means.

2. The throttle valve positioning control apparatus, for controlling the positioning of a throttle valve situated to control the amount of air permitted to enter an internal combustion engine operable in a plurality of control modes, comprising:

drive means responsive to a drive signal indicating a target throttle valve position for moving the throttle valve to the target throttle valve position;

sensor means sensitive to the movement of the throttle valve for producing a sensor signal indicative of a sensed throttle valve position; and control means connected between the sensor means and the drive means for producing the drive signal to bring the sensed throttle valve position into coincidence with the target throttle valve position, the control means including disturbance estimating means for estimating disturbances introduced onto the drive means and the sensor means based on the target and sensed throttle valve positions, and means for correcting the target throttle valve position based on the estimated disturbances, wherein the sensor means includes a sensor for producing an analog sensor signal indicative of the sensed throttle valve position and an analog-to-digital converter for repetitively converting the analog sensor signal into a corresponding digital value at uniform intervals of time, and means for averaging the digital values converted for a predetermined period of time to produce the sensor signal.

3. The throttle valve positioning control apparatus as claimed in claim 2, wherein the disturbance estimating means has a frequency characteristic changed according to the control mode where the engine is operating.

4. The throttle valve positioning control apparatus as claimed in claim 2, wherein the control means includes a feedback type model matching compensator and a feed forward type phase compensator for causing the sensed throttle valve position to follow the target throttle valve position in a predetermined response characteristic.

5. The throttle valve positioning control apparatus as claimed in claim 2, further including low pass filters provided at respective inputs of the disturbance estimating means for eliminating noises introduced onto the inputs of the disturbance estimating means.

6. The throttle valve positioning control apparatus as claimed in claim 2, further including a low pass filter provided at an output of the disturbance estimating means for eliminating noises introduced onto the output of the disturbance estimating means.

7. The throttle valve positioning control apparatus as claimed in claim 2, wherein the sensor means includes means for changing the time interval according to the control mode where the engine is operating.

8. The throttle valve positioning control apparatus as claimed in claim 7, wherein the disturbance estimating means has a frequency characteristic changed according to the control mode where the engine is operating.

9. The throttle valve positioning control apparatus as claimed in claim 7, wherein the control means includes a feedback type model matching compensator and a feed forward type phase compensator for causing the sensed throttle valve position to follow the target throttle valve position in a predetermined response characteristic.

10. The throttle valve positioning control apparatus as claimed in claim 7, further including low pass filters provided at respective inputs of the disturbance estimating means for eliminating noises introduced onto the inputs of the disturbance estimating means.

11. The throttle valve positioning control apparatus as claimed in claim 7, further including a low pass filter provided at an output of the disturbance estimating means for eliminating noises introduced onto the output of the disturbance estimating means.

12. An apparatus for controlling the positioning of a throttle valve situated to control the amount of air permitted to enter an internal combustion engine operable in a plurality of control modes, comprising:

drive means responsive to a drive signal indicating a target throttle valve position for moving the throttle valve to the target throttle valve position;

sensor means sensitive to the movement of the throttle valve for producing a digital sensor signal indicative of a sensed throttle valve position; and control means connected between the sensor means and the drive means for producing the drive signal to bring the sensed throttle valve position into coincidence with the target throttle valve position, the control means including disturbance estimating means for estimating disturbances introduced onto the drive means and the sensor means based on the target and sensed throttle valve positions, and means for correcting the target throttle valve position based on the estimated disturbances;

wherein the sensor means includes a sensor for producing an analog sensor signal indicative of the sensed throttle valve position, a plurality of amplifiers for amplifying the analog sensor signal at different amplification factors, analog-to-digital converters for converting the respective amplified analog sensor signals into corresponding digital values, and means for selecting one of the digital values according to the control mode where the engine is operating to produce the sensor signal.

13. The throttle valve positioning control apparatus as claimed in claim 12, wherein the disturbance estimating means has a frequency characteristic changed according to the control mode where the engine is operating.

14. The throttle valve positioning control apparatus as claimed in claim 12, wherein the control means includes a feedback type model matching compensator and a feed forward type phase compensator for causing the sensed throttle valve position to follow the target throttle valve position in a predetermined response characteristic.

15. The throttle valve positioning control apparatus as claimed in claim 12, further including low pass filters provided at respective inputs of the disturbance estimating means for eliminating noises introduced onto the inputs of the disturbance estimating means.

16. The throttle valve positioning control apparatus as claimed in claim 12, further including a low pass filter provided at an output of the disturbance estimating means for eliminating noises introduced onto the output of the disturbance estimating means.

17. The throttle valve positioning control apparatus, for controlling the positioning of a throttle valve situated to control the amount of air permitted to enter an internal combustion engine operable in a plurality of control modes, comprising:

drive means responsive to a drive signal indicating a target throttle valve position for moving the throttle valve to the target throttle valve position;

sensor means sensitive to the movement of the throttle valve for producing a sensor signal indicative of a sensed throttle valve position; and control means connected between the sensor means and the drive means for producing the drive signal to bring the sensed throttle valve position into coincidence with the target throttle valve position, the control means including disturbance estimating means for estimating disturbances introduced onto the drive means and the sensor means based on the target and sensed throttle valve positions, and means for correcting the target throttle valve position based on the estimated disturbances, wherein the sensor means includes a sensor for producing analog sensor signal indicative of the sensed throttle valve position, a plurality of amplifiers for amplifying factors, analog-to-digital converters for converting the respective amplified analog sensor signals into corresponding digital values, and means for interpolating the digital values to produce the sensor signal.

18. The throttle valve positioning control apparatus as claimed in claim 17, wherein the disturbance estimating means has a frequency characteristic changed according to the control mode where the engine is operating.

19. The throttle valve positioning control apparatus as claimed in claim 17, wherein the control means includes a feedback type model matching compensator and a feed forward type phase compensator for causing the sensed throttle valve position to follow the target throttle valve position in a predetermined response characteristic.

20. The throttle valve positioning control apparatus as claimed in claim 17, further including low pass filters provided at respective inputs of the disturbance estimating means for eliminating noises introduced onto the inputs of the disturbance estimating means.

21. The throttle valve positioning control apparatus as claimed in claim 17, further including a low pass filter provided at an output of the disturbance estimating means for eliminating noises introduced onto the output of the disturbance estimating means.

22. The throttle valve positioning control apparatus as claimed in claim 17, wherein the sensor means includes means for selecting one of the digital values according to the control mode where the engine is operating, and means for interpolating the digital values based on the selected digital value to produce the digital sensor signal to the control means.

23. The throttle valve positioning control apparatus as claimed in claim 22, wherein the disturbance estimating means has a frequency characteristic changed according to the control mode where the engine is operating.

24. The throttle valve positioning control apparatus as claimed in claim 22, wherein the control means includes a feedback type model matching compensator and a feed forward type phase compensator for causing the sensed throttle valve position to follow the target throttle valve position in a predetermined response characteristic.

25. The throttle valve positioning control apparatus as claimed in claim 22, further including low pass filters provided at respective inputs of the disturbance estimating means for eliminating noises introduced onto the inputs of the disturbance estimating means.

26. The throttle valve positioning control apparatus as claimed in claim 22, further including a low pass filter provided at an output of the disturbance estimating means for eliminating noises introduced onto the output of the disturbance estimating means.

27. The throttle valve positioning control apparatus as claimed in claim 17, wherein the sensor means includes means for interpolating the digital values based on the interpolated value obtained in the last cycle of production of the digital sensor signal to produce the digital sensor signal to the control means.

28. The throttle valve positioning control apparatus as claimed in claim 27, wherein the disturbance estimating means has a frequency characteristic changed according to the control mode where the engine is operating.

29. The throttle valve positioning control apparatus as claimed in claim 27, wherein the control means includes a feedback type model matching compensator and a feed forward type phase compensator for causing the sensed throttle valve position to follow the target throttle valve position in a predetermined response characteristic.

30. The throttle valve positioning control apparatus as claimed in claim 27, further including low pass filters provided at respective inputs of the disturbance estimating means for eliminating noises introduced onto the inputs of the disturbance estimating means.

31. The throttle valve positioning control apparatus as claimed in claim 27, further including a low pass filter provided at an output of the disturbance estimating means for eliminating noises introduced onto the output of the disturbance estimating means.

* * * * *